US005882281A

United States Patent [19]

Stearns et al.

[11] Patent Number: 5,882,281

[45] Date of Patent: Mar. 16, 1999

[54] EXERCISE METHODS AND APPARATUS

[76] Inventors: Kenneth W. Stearns, P.O. Box 55912, Houston, Tex. 77055; Joseph D. Maresh, P.O. Box 645, West Linn, Oreg. 97068-0645

[21] Appl. No.: 64,393

[22] Filed: Apr. 22, 1998

Related U.S. Application Data

[63] Continuation-in-part of Ser. No. 839,991, Apr. 24, 1997.

[60] Provisional application Nos. 60/044,956 and 60/044,961 Apr. 26, 1997 and 60/051,825 Jul. 7, 1997.

[51] Int. Cl.[6] ..... A63B 22/00; A63B 69/16

[52] U.S. Cl. ..... 482/51; 482/70

[58] Field of Search ..... 482/51, 52, 53, 482/57, 70, 79, 80, 71, 60, 62, 148

[56] References Cited

U.S. PATENT DOCUMENTS

| | | | |
|---|---|---|---|
| 5,242,343 | 9/1993 | Miller | 482/57 |
| 5,423,729 | 6/1995 | Eschenbach | 482/70 |
| 5,540,637 | 7/1996 | Rodgers | 482/52 |
| 5,573,480 | 11/1996 | Rodgers | 482/51 |
| 5,759,136 | 6/1998 | Chen | 482/57 |

*Primary Examiner*—Stephen R. Crow

[57] ABSTRACT

An exercise apparatus links rotation of a crank to generally elliptical motion of a foot supporting member. A support member is movably supported between a frame and a crank rotatably mounted on the frame. The foot supporting member moves vertically together with the support member and horizontally relative to the support member.

2 Claims, 19 Drawing Sheets

Fig. 16
Fig. 18
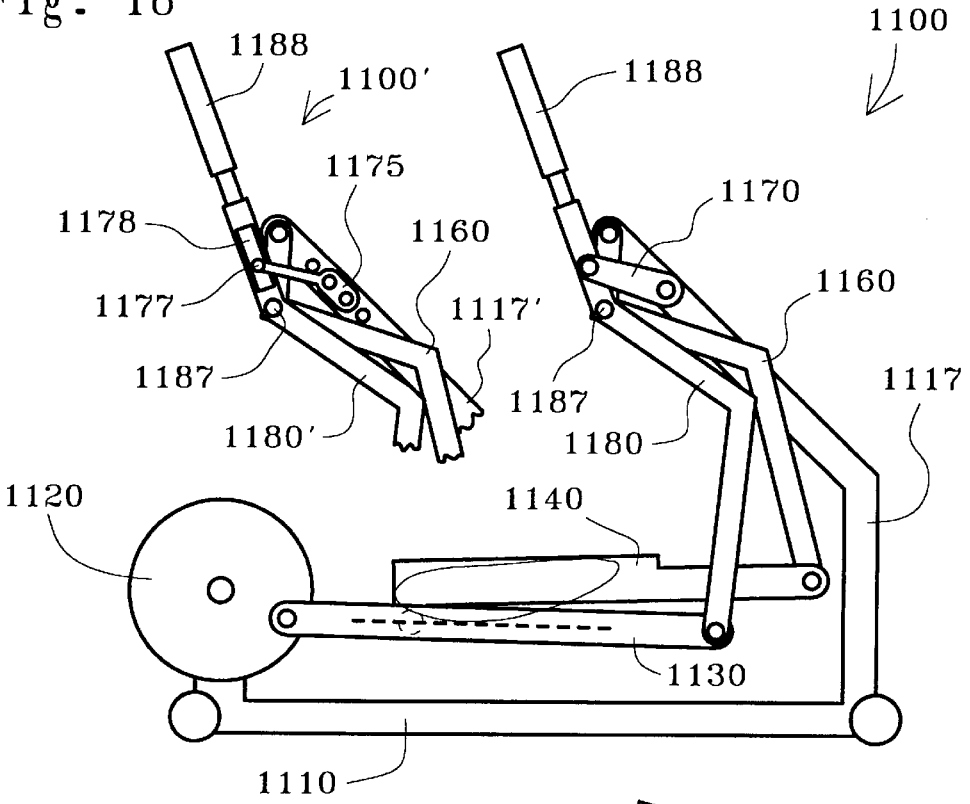
Fig. 17
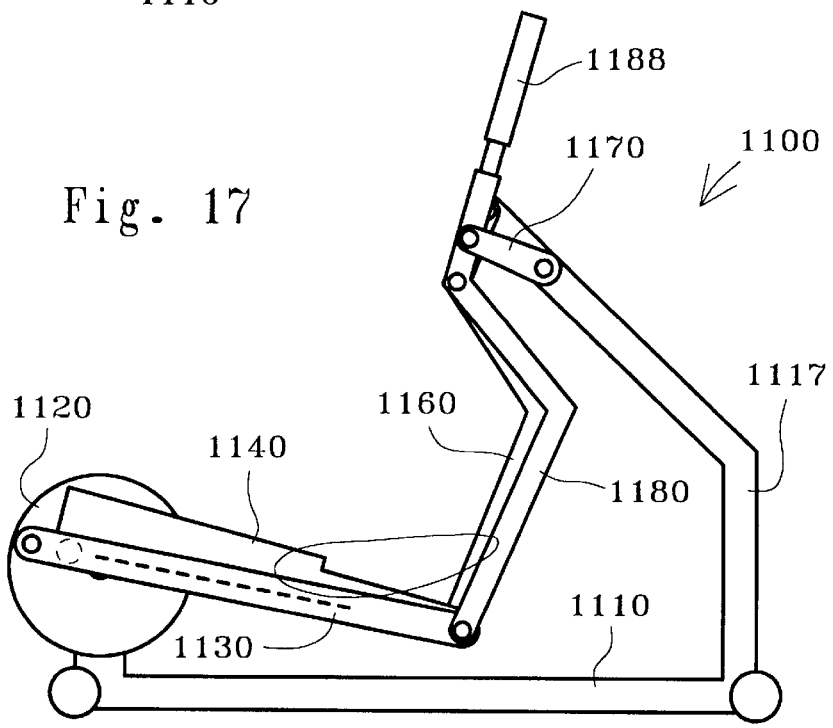

EXERCISE METHODS AND APPARATUS

CROSS-REFERENCE TO RELATED APPLICATIONS

This application is a continuation-in-part of U.S. patent application Ser. No. 08/839,991, which was filed on Apr. 24, 1997; and also discloses subject matter entitled to the earlier filing dates of Provisional Application Ser. Nos. 60/044,956 and 60/044,961, which were filed on Apr. 26, 1997; and Provisional Application Ser. No. 60/051,825, which was filed on Jul. 7, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Many types of equipment also incorporate reciprocating cables or pivoting handles to facilitate upper body exercise as well as lower body exercise. Despite advances in the art, room for continued innovation remains.

SUMMARY OF THE INVENTION

The present invention may be seen to provide a novel linkage assembly and corresponding exercise apparatus suitable for linking circular motion to relatively more complex, generally elliptical motion. In this regard, a first end of a rail is movably supported by a frame, and a second end of the rail is movably supported by a crank. A foot skate is movably supported by the rail and is moved horizontally relative thereto by at least one crank driven link. Rotation of the crank causes up and down movement of the foot skate together with the rail, and the crank driven link causes back and forth movement of the foot skate relative to the rail. The resulting linkage assembly constrains the force receiving member to travel through a generally elliptical path, having a relatively longer major axis and a relatively shorter minor axis.

In another respect, the present invention may be seen to provide a novel linkage assembly and corresponding exercise apparatus suitable for linking reciprocal motion to relatively more complex, generally elliptical motion. In this regard, a handle member is movably interconnected between the frame and at least one link in the linkage assembly, and is constrained to move in reciprocal fashion relative to both. As the foot support moves through its generally elliptical path, the handle member pivots back and forth relative to the frame member.

In yet another respect, the present invention may be seen to provide a novel linkage assembly and corresponding exercise apparatus suitable for adjusting the angle of the generally elliptical path of motion relative to a horizontal surface on which the apparatus rests. In this regard, the frame includes a first frame member which supports the rail and is selectively locked in any of a plurality of positions relative to a second frame member. An increase in the elevation of the first frame member results in a relatively more strenuous, "uphill" exercise motion.

In still another respect, the present invention may be seen to provide a novel linkage assembly and corresponding exercise apparatus suitable for adjusting the stride length of the generally elliptical path of motion. In this regard, the crank driven link may be adjusted relative to one or more of the remaining linkage assembly components to alter its affect on the foot skate. Many of the advantages of the present invention may become apparent from the more detailed description that follows.

BRIEF DESCRIPTION OF THE DRAWING

With reference to the Figures of the Drawing, wherein like numerals represent like parts and assemblies throughout the several views.

FIG. 16 is a side view of yet another exercise apparatus constructed according to the principles of the present invention;

FIG. 17 is a side view of the exercise apparatus of Figure 16 at a different point in an exercise cycle;

FIG. 18 is a side view of an alternative linkage suitable for use on the exercise apparatus of FIG. 16;

DETAILED DESCRIPTION OF THE PREFERRED EMBODIMENT

Figure 1:
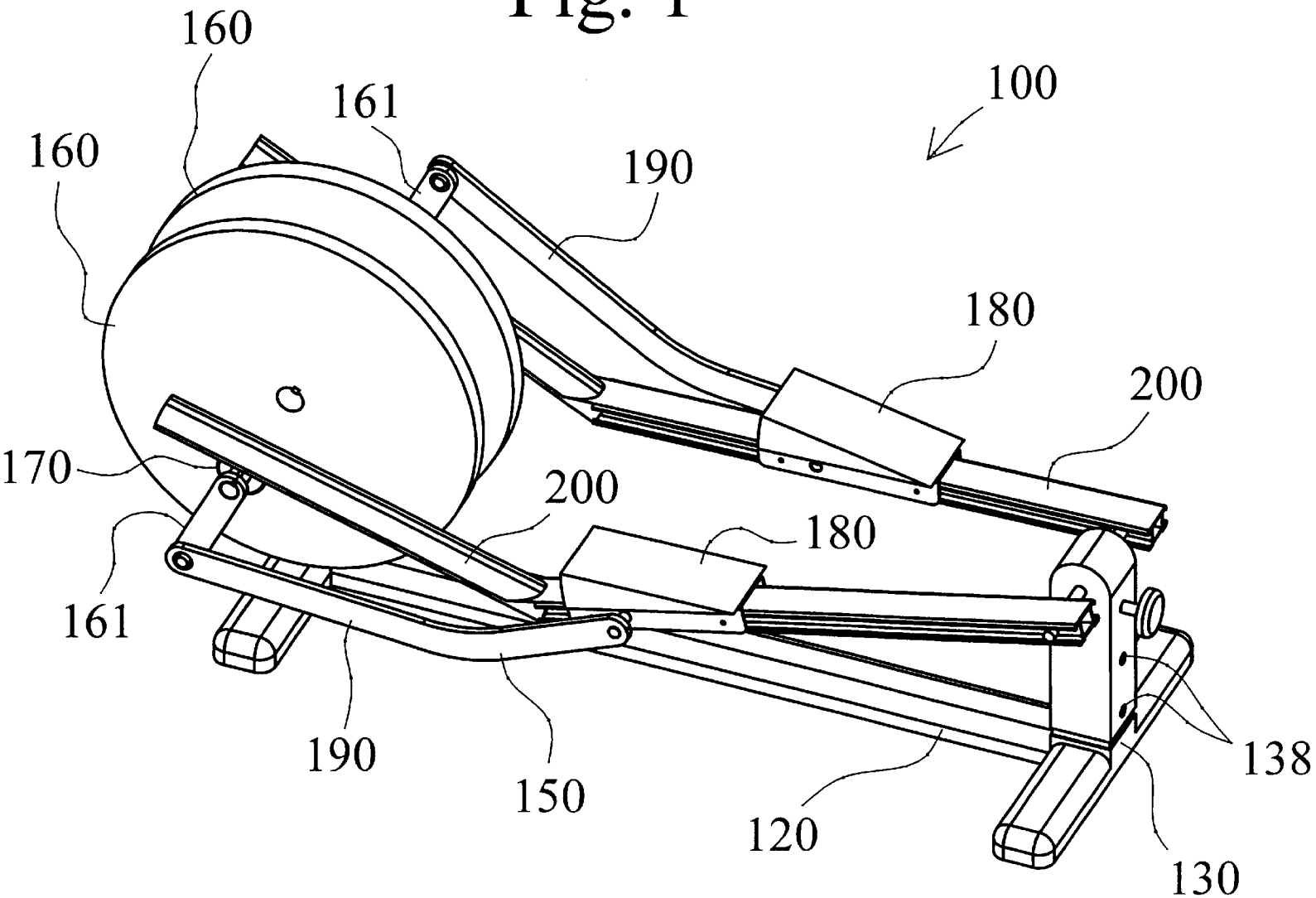
FIG. 1 is a perspective view of an exercise apparatus constructed according to the principles of the present invention.
Figure 2:
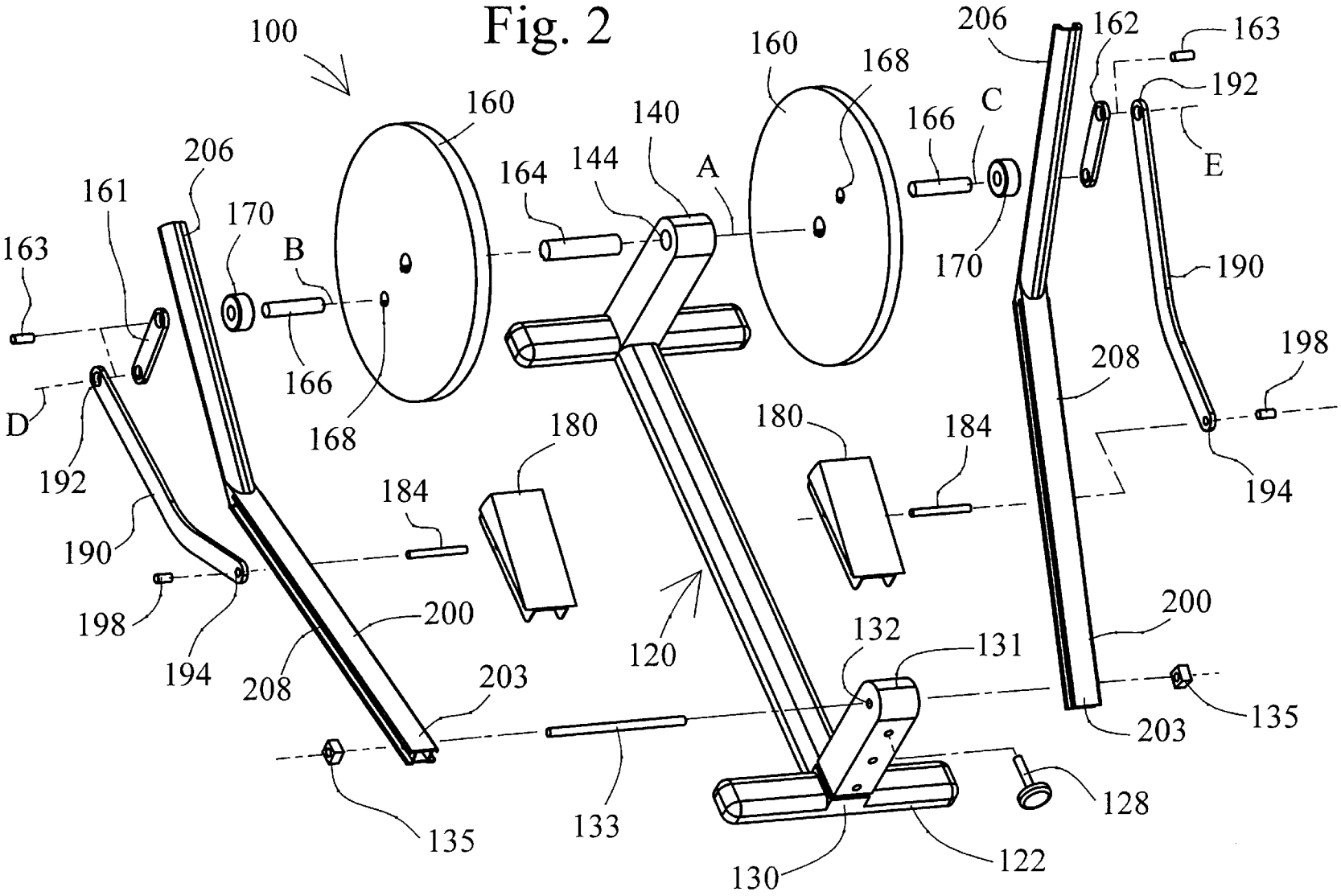
FIG. 2 is an exploded perspective view of the exercise apparatus of FIG. 1.
Figure 3:
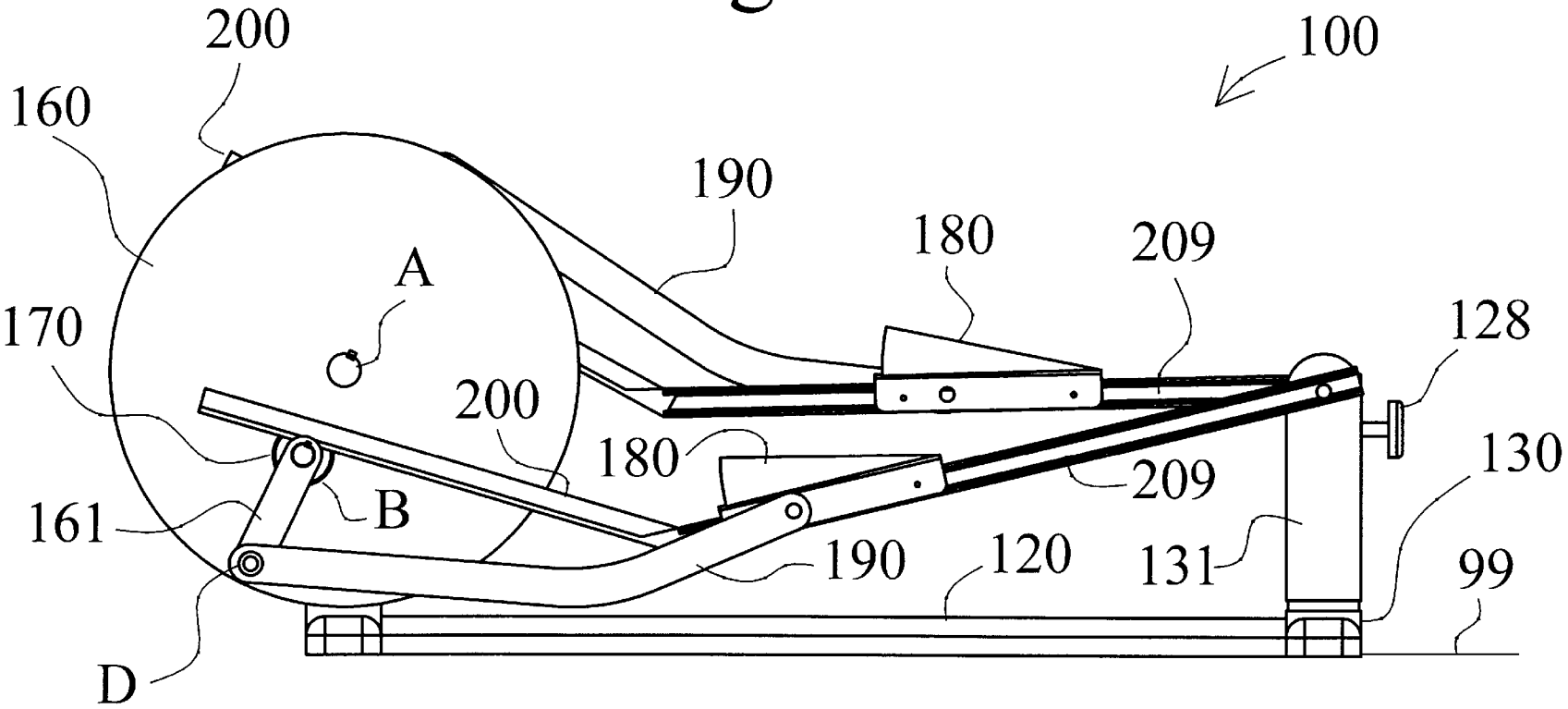
FIG. 3 is a side view of the exercise apparatus of FIG. 1.
Figure 4:
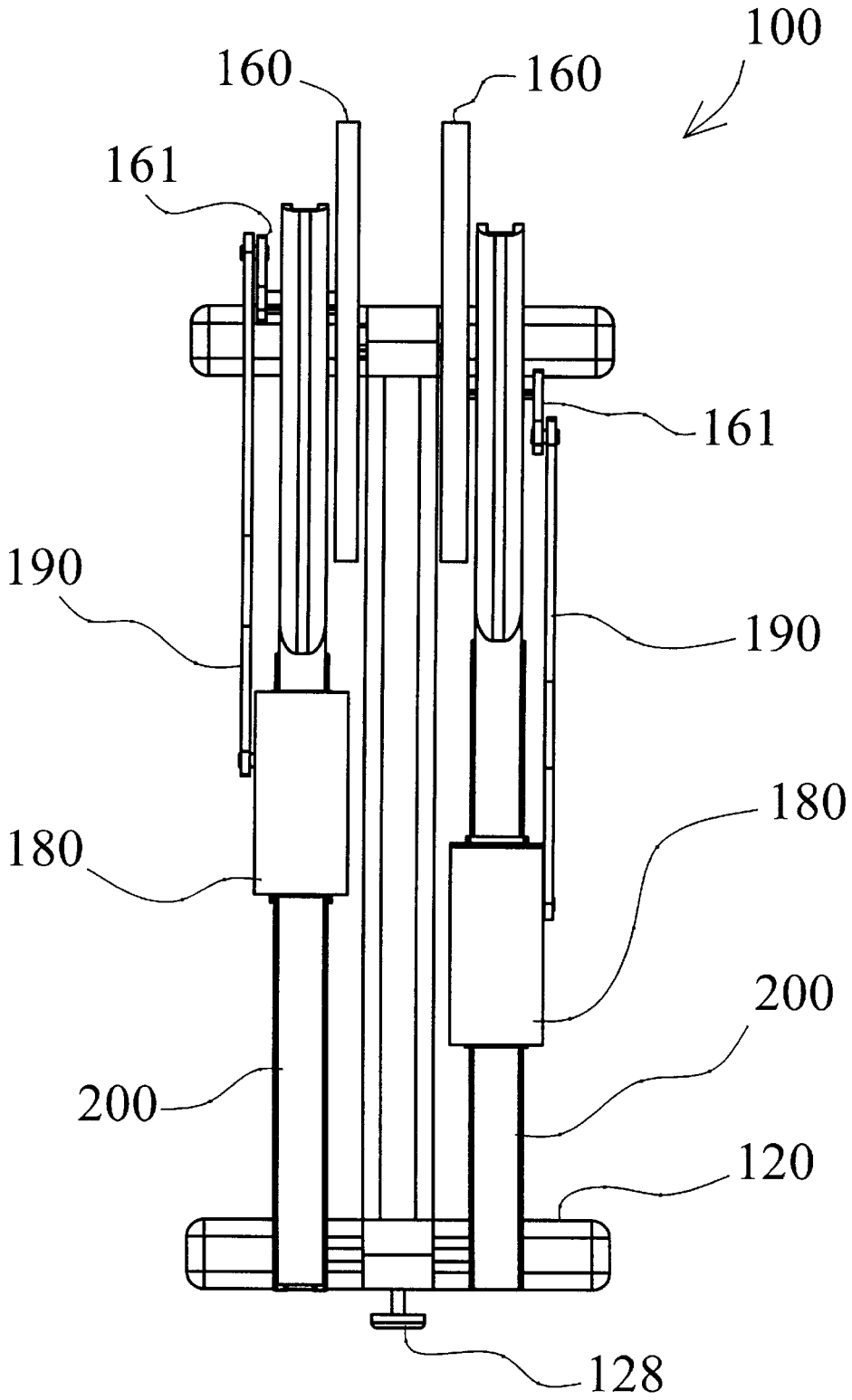
FIG. 4 is a top view of the exercise apparatus of FIG. 1.
Figure 5:
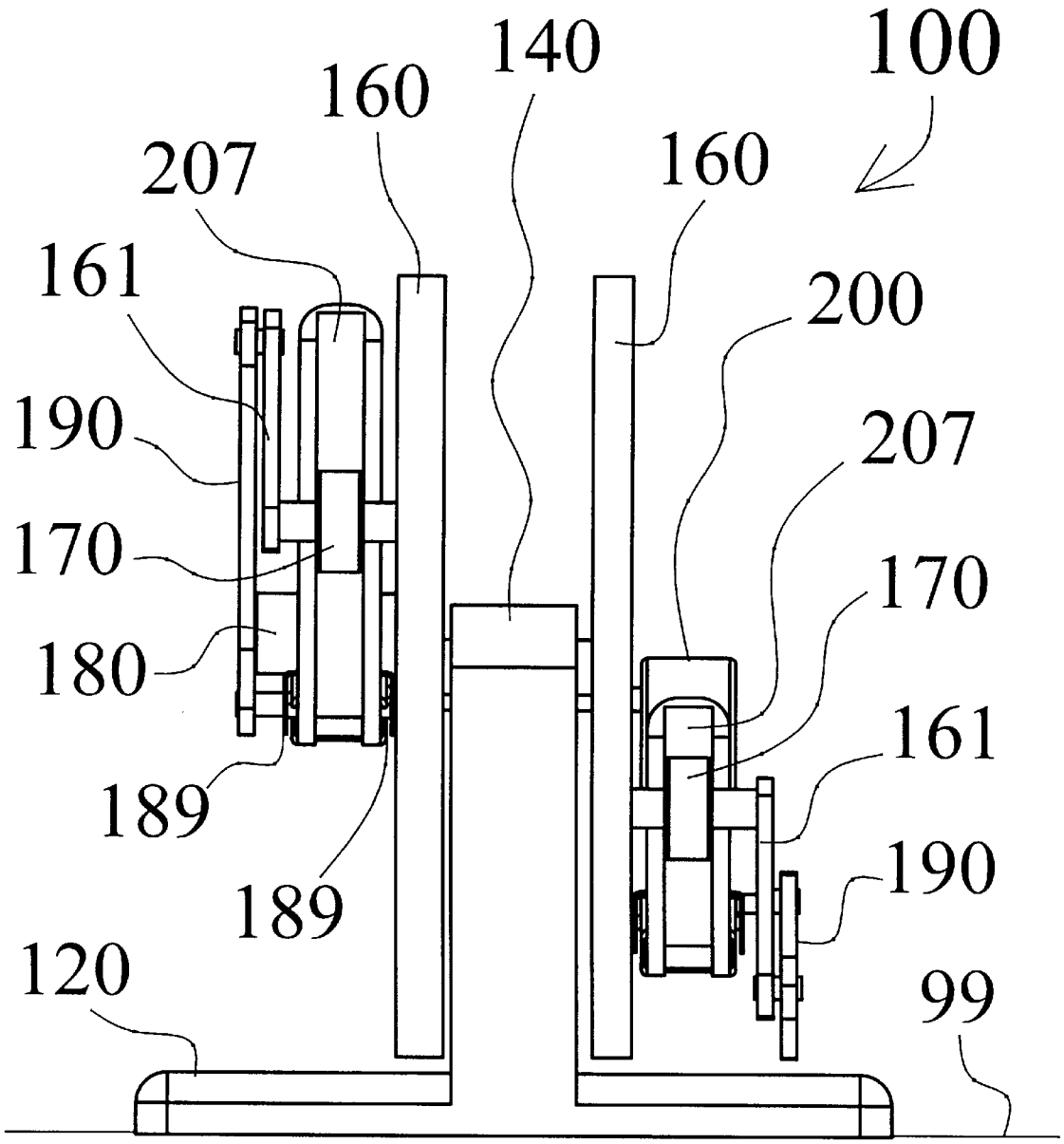
FIG. 5 is a rear view of the exercise apparatus of FIG. 1.
Figure 6A:
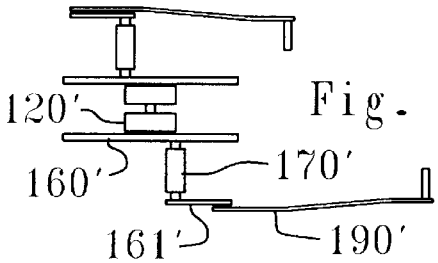
FIG. 6A is a top view of part of the linkage assembly on the exercise apparatus of FIG. 1.
Figure 6B:
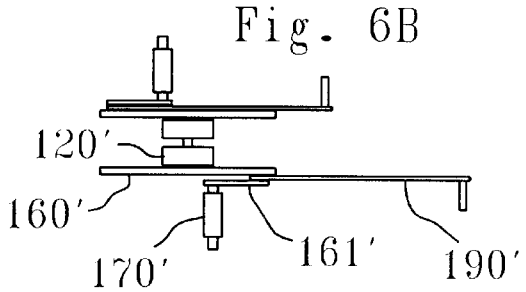
FIG. 6B is a top view of a linkage assembly similar to that of FIG. 6A, showing a second, discrete arrangement of the linkage assembly components.
Figure 6C:
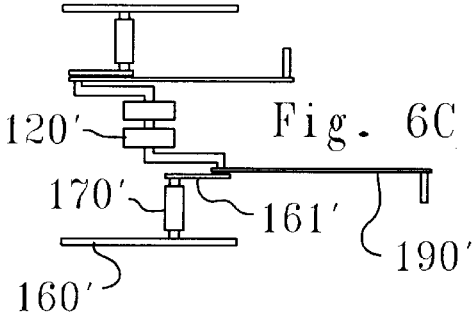
FIG. 6C is a top view of a linkage assembly similar to that of FIG. 6A, showing a third, discrete arrangement of the linkage assembly components.
Figure 6D:
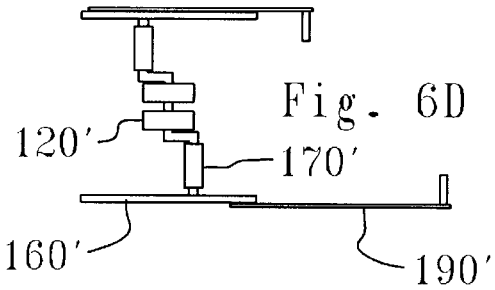
FIG. 6D is a top view of a linkage assembly similar to that of FIG. 6A, showing a fourth, discrete arrangement of the linkage assembly components.
Figure 6E:
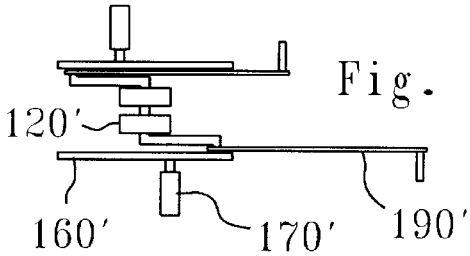
FIG. 6E is a top view of a linkage assembly similar to that of FIG. 6A, showing a fifth, discrete arrangement of the linkage assembly components.
Figure 6F:
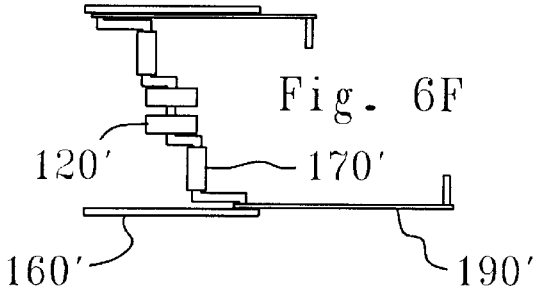
FIG. 6F is a top view of a linkage assembly similar to that of FIG. 6A, showing a sixth, discrete arrangement of the linkage assembly components.
Figure 6G:
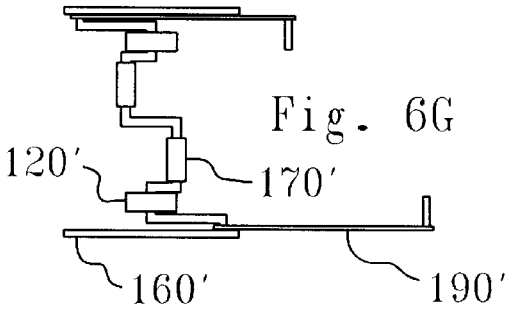
FIG. 6G is a top view of a linkage assembly similar to that of FIG. 6A, showing a seventh, discrete arrangement of the linkage assembly components.
Figure 6H:
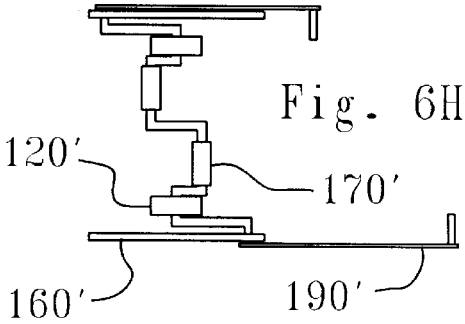
FIG. 6H is a top view of a linkage assembly similar to that of FIG. 6A, showing an eighth, discrete arrangement of the linkage assembly components.
Figure 6I:
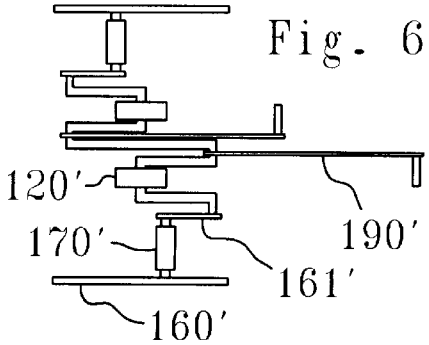
FIG. 6I is a top view of a linkage assembly similar to that of FIG. 6A, showing a ninth, discrete arrangement of the linkage assembly components.
Figure 6J:
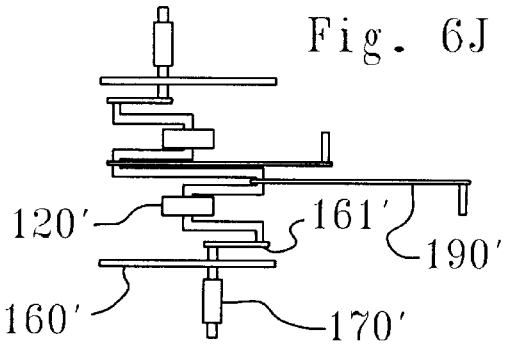
FIG. 6J is a top view of a linkage assembly similar to that of FIG. 6A, showing a tenth, discrete arrangement of the linkage assembly components.

A first embodiment exercise apparatus constructed according to the principles of the present invention is designated as 100 in FIGS. 1–5. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180. The term "elliptical motion" is intended in a broad sense to describe a closed path of motion having a relatively longer first axis and a relatively shorter second axis (which extends perpendicular to the first axis).

The frame 120 includes a base 122, a forward stanchion 130, and a rearward stanchion 140. The base 122 may be described as generally I-shaped and is designed to rest upon a generally horizontal floor surface 99 (see FIGS. 3 and 5). Both the apparatus 100 and other embodiments shown and/or described herein are generally symmetrical about a vertical plane extending lengthwise through the base (perpendicular to the transverse ends thereof), the only exception being the relative orientation of certain parts of the linkage assembly on opposite sides of the plane of symmetry. In general, the "right-hand" components are one hundred and eighty degrees out of phase relative to the "left-hand" components. However, like reference numerals are used to designate both the "right-hand" and "left-hand" parts, and when reference is made to one or more parts on only one side of the apparatus, it is to be understood that corresponding part(s) are disposed on the opposite side of the apparatus.

Those skilled in the art will also recognize that the portions of the frame which are intersected by the plane of symmetry exist individually and thus, do not have any "opposite side" counterparts. Also, to the extent that reference is made to forward or rearward portions of the apparatus, it is to be understood that a person can typically exercise on the apparatus while facing in either direction relative to the linkage assembly. Furthermore, many of the embodiments may be modified by adding any of various known inertia altering devices, including, for example, a motor, a "stepped up" flywheel, or an adjustable brake of some sort. Moreover, although many of the rotationally interconnected components are shown to be cantilevered relative to one another, many such components could be modified so that an end of a first component nests between opposing prongs on the end of a second component.

The forward stanchion 130 extends perpendicularly upward from the base 122 and supports a telescoping tube 131. A plurality of holes 138 are formed in the tube 131, and a single hole is formed in the upper end of the stanchion 130 to selectively align with any one of the holes 138. A pin 128, having a ball detent, may be inserted through an aligned set of holes to secure the tube 131 in a raised position relative to the stanchion 130. A laterally extending hole 132 is formed through the tube 131.

The rearward stanchion 140 extends perpendicularly upward from the base 122 and supports a bearing assembly. An axle 164 is inserted through a laterally extending hole 144 in the bearing assembly to support a pair of flywheels 160 in a manner known in the art. For example, the axle 164 may be inserted through the hole 144, and then a flywheel 160 may be keyed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

A radially displaced shaft 166 is rigidly secured to each flywheel 160 by means known in the art. For example, the shaft 166 may be inserted into a hole 168 in the flywheel 160 and welded in place. The shaft 166 is secured to the flywheel 160 at a point radially displaced from the axis A, and thus, the shaft 166 rotates at a fixed radius about the axis A. In other words, the shaft 166 and the flywheel 160 cooperate to define a first crank having a first crank radius.

A roller 170 is rotatably mounted on each shaft 166. The roller 170 on the right side of the apparatus 100 rotates about an axis B, and the roller 170 on the left side of the apparatus 100 rotates about an axis C. A rigid member or crank arm 161 is fixedly secured to each shaft 166 by means known in the art. For example, the shaft 166 may be inserted into a hole in the rigid member 161 and then keyed in place. The roller 170 is retained on the shaft 164 between the flywheel 160 and the rigid member 161.

Each rigid member 161 extends from the shaft 166 to a distal end 162 which occupies a position radially displaced from the axis A and rotates at a fixed radius about the axis A. In other words, the distal end 162 and the flywheel 160, together with the parts interconnected therebetween, cooperate to define a second crank having a second, relatively greater crank radius. On the apparatus 100, the second crank and the first crank are portions of a single unitary member and share a common rotational axis A.

A link 190 has a rearward end 192 rotatably connected to the distal end 162 of the member 161 by means known in the art. For example, holes may be formed through distal end 162 and the rearward end 192, and a rivet-like fastener 163 may inserted through the holes and secured therebetween. As a result of this arrangement, the link 190 on one side of the apparatus 100 rotates about an axis D relative to a respective distal end 162 and flywheel 160; and the link 190 on the other side of the apparatus 100 rotates about an axis E relative to a respective distal end 162 and flywheel 160. On the apparatus 100, the axes A, B, and D may be said to be radially aligned, and the axes A, C, and E may be said to be radially aligned. Also, the axes B and D may be said to be diametrically opposed from the axes C and E.

Each link 190 has a forward end 194 rotatably connected to a respective force receiving member 180 by means known in the art. For example, a pin 184 may be secured to the force receiving member 180, and a hole may be formed through the forward end 194 of the link 190 to receive the pin 184. A nut 198 may then be threaded onto the distal end of the pin 184. As a result of this arrangement, the link 190 may be said to be rotatably interconnected between the flywheel 160 and the force receiving member 180, and/or to provide a discrete means for interconnecting the flywheel 160 and the force receiving member 180.

Each force receiving member 180 is rollably mounted on a respective rail or track 200 and thus, may be described as a skate or truck. Each force receiving member 180 provides an upwardly facing support surface 188 sized and configured to support a person's foot.

Each rail 200 has a forward end 203, a rearward end 206, and an intermediate portion 208. The forward end 203 of each rail 200 is movably connected to the frame 120, forward of the flywheels 160. In particular, each forward end 203 is rotatably connected to the forward stanchion 130 by means known in the art. For example, a shaft 133 may be inserted into the hole 132 through the tube 131 and into holes through the forward ends 203 of the rails 200. The shaft 133 may be keyed in place relative to the stanchion 130, and nuts 135 may be secured to opposite ends of the shaft 133 to retain the forward ends 203 on the shaft 133. As a result of this arrangement, the rail 200 may be said to provide a discrete means for movably interconnecting the force receiving member 180 and the frame 120.

The rearward end 206 of the rail 200 is supported or carried by the roller 170. In particular, the rearward end 206 may be generally described as having an inverted U-shaped profile into which an upper portion of the roller 170 protrudes. The "base" of the inverted U-shaped profile is defined by a flat bearing surface 207 which bears against or rides on the cylindrical surface of the roller 170. Those skilled in the art will recognize that other structures (e.g. studs) could be substituted for the rollers 170. In any case, the rail 200 may be said to provide a discrete means for movably interconnecting the flywheel 160 and the force receiving member 180.

The intermediate portion 208 of the rail 200 may be defined as that portion of the rail 200 along which the skate 180 may travel and/or as that portion of the rail 200 between the rearward end 206 (which rolls over the roller 170) and the forward end 203 (which is rotatably mounted to the frame 120). The intermediate portion 208 may be generally described as having an I-shaped profile or as having a pair of C-shaped channels which open away from one another. Each channel 209 functions as a race or guide for one or more rollers 189 rotatably mounted on each side of the foot skate 180. Those skilled in the art will recognize that other structures (e.g. bearings) could be substituted for the rollers 189.

On the apparatus 100, both the end portion 206 and the intermediate portion 208 of the support member 200 are linear. However, either or both may be configured as a curve without departing from the scope of the present invention. Moreover, although the end portion 206 is fixed relative to the intermediate portion 208, an orientation adjustment could be provided on an alternative embodiment, as well.

Those skilled in the art will also recognize that each of the components of the linkage assembly 150 is necessarily long enough to facilitate the depicted interconnections. For example, the members 161 and the links 190 must be long enough to interconnect the flywheel 160 and the force receiving member 180 and accommodate a particular crank radius. Furthermore, for ease of reference in both this detailed description and the claims set forth below, the components are sometimes described with reference to "ends" being connected to other parts. For example, the link 190 may be said to have a first end rotatably connected to the member 161 and a second end rotatably connected to the force receiving member 180. However, those skilled in the art will recognize that the present invention is not limited to links which terminate immediately beyond their points of connection with other parts. In other words, the term "end" should be interpreted broadly, in a manner that could include "rearward portion", for example; and in a manner wherein "rear end" could simply mean "behind an intermediate portion", for example.

Those skilled in the art will further recognize that the above-described components of the linkage assembly 150 may be arranged in a variety of ways. For example, in each of FIGS. 6A–6J, flywheels 160', support rollers 170', members 161', and links 190' are shown in several alternative configurations relative to one another and the frame 120' (in some embodiments, there is no need for a discrete part 161' because both the links 190' and the rollers 170' are connected directly to the flywheels 160').

In operation, rotation of the flywheel 160 causes the shaft 166 to revolve about the axis A, thereby pivoting the rail 200 up and down relative to the frame 120, through a range of motion equal to twice the radial distance between the axis A and either axis B or C. Rotation of the flywheel 160 also causes the distal end 162 of the member 161 to revolve about the axis A, thereby moving the force receiving member 180 back and forth along the rail 200, through a range of motion equal to twice the radial distance between the axis A and either axis D or E. In other words, the present invention facilitates movement of a force receiving member through a path having a horizontal component which is not necessarily related to or limited by the vertical component. As a result, it is a relatively simple matter to design an apparatus with a desired "aspect ratio" for the elliptical path to be traveled by the foot platform. For example, movement of the axes D and E farther from the axis A and/or movement of the axes B and C closer to the axis A will result in a relatively flatter path. Ultimately, the exact size, configuration, and arrangement of the linkage assembly components are a matter of design choice.

In general, the present invention may also be characterized in terms of an exercise apparatus, comprising: a frame designed to rest upon a floor surface; left and right cranks mounted on opposite sides of said frame and rotatable relative thereto about a common crank axis; and left and right linkage assemblies disposed on opposite sides of said frame and including: respective first portions connected to respective cranks at diametrically opposed locations relative to said crank axis, and thereby defining a crank diameter between said locations; respective second portions movably connected to said frame at an end opposite said cranks; and respective foot supports interconnected between respective first portions and respective second portions and movable relative to said frame through a distance greater than said crank diameter.

Another way to characterize the present invention is as an exercise apparatus, comprising: a frame designed to rest upon a floor surface; left and right cranks rotatably mounted on said frame; left and right rails having first ends supported by respective cranks and second ends supported by said frame; and left and right foot supports movably mounted on respective rails and connected to respective cranks in such a manner that rotation of said cranks causes each of said foot supports to move vertically together with a respective rail and horizontally relative to a respective rail.

The present invention may be described in terms of methods, as well. For example, the present invention provides a method of linking rotation of left and right cranks to generally elliptical motion of left and right foot supporting members, comprising the steps of: providing a frame sized and configured to support a person relative to an underlying floor surface; rotatably mounting the left and right cranks on the frame; movably interconnecting left and right rails between the frame and respective cranks; and movably mounting left and right foot supports on respective rails and connecting the foot supports to respective cranks in such a manner that rotation of the cranks causes each of the foot supports to move vertically together with a respective rail and horizontally relative to a respective rail.

Figure 7:
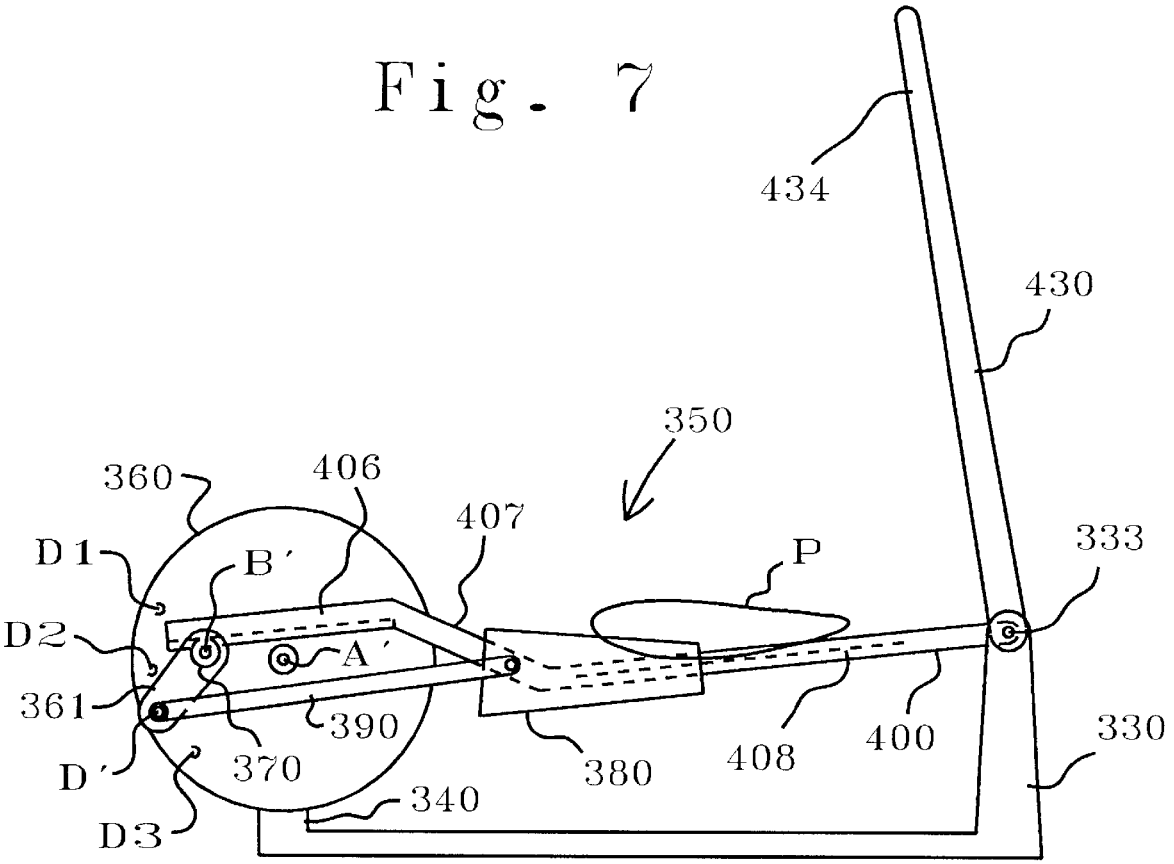
FIG. 7 is a side view of an alternative embodiment exercise apparatus constructed according to the principles of the present invention.

The spatial relationships, including the radii and angular displacement of the crank axes, may vary for different sizes, configurations, and arrangements of the linkage assembly components. For example, another embodiment of the present invention is shown in FIG. 7 and designated as 300. The exercise apparatus 300 includes a linkage assembly 350 movably mounted on a frame 320, and a handle member 430 movably mounted on the frame 320, as well.

Like on the first apparatus 100, a flywheel 360 is rotatably connected to a rearward stanchion 340 on the frame 320 and rotates about an axis A'; and a roller 370 is rotatably connected to the flywheel 360 and rotates about an axis B', which is radially offset from the axis A'. A rigid member 361 extends from a first end connected to the flywheel 360, proximate axis B', to a second end which is radially offset and circumferentially displaced from the axis B'. A link 390 has a rearward end rotatably connected to the distal end of the member 361. The link 390 rotates about an axis D' relative to the member 361. Simply by varying the size, configuration, and/or orientation of the member 361 and/or the link 390, any of various rotational link axes (D1–D3, for example) may be provided in place of the axis D.

An opposite, forward end of the link 390 is rotatably connected to a force receiving member 380 that rolls along an intermediate portion 408 of a rail 400. A rearward end 406 of the rail 400 is supported on the roller 370. On this embodiment 300, a discrete segment 407 separates or offsets the rearward end 406 and the intermediate portion 408.

A forward end of the rail 400 is pivotally connected to a forward stanchion 330 on the frame 320 by means of a shaft 333. The handle member 430 is also pivotally connected to the forward stanchion 330 by means of the same shaft 333. As a result, the handle member 430 and the rail 400 independently pivot about a common pivot axis. The handle member 430 includes an upper, distal portion 434 which is sized and configured for grasping by a person standing on the force receiving member 380. In operation, the alternative embodiment 300 allows a person to selectively perform arm exercise, by pivoting the handle 430 back and forth, while also performing leg exercise, by driving the force receiving member 380 through the path of motion P (as traced with reference to the approximate center of the foot supporting surface).

Figure 8:
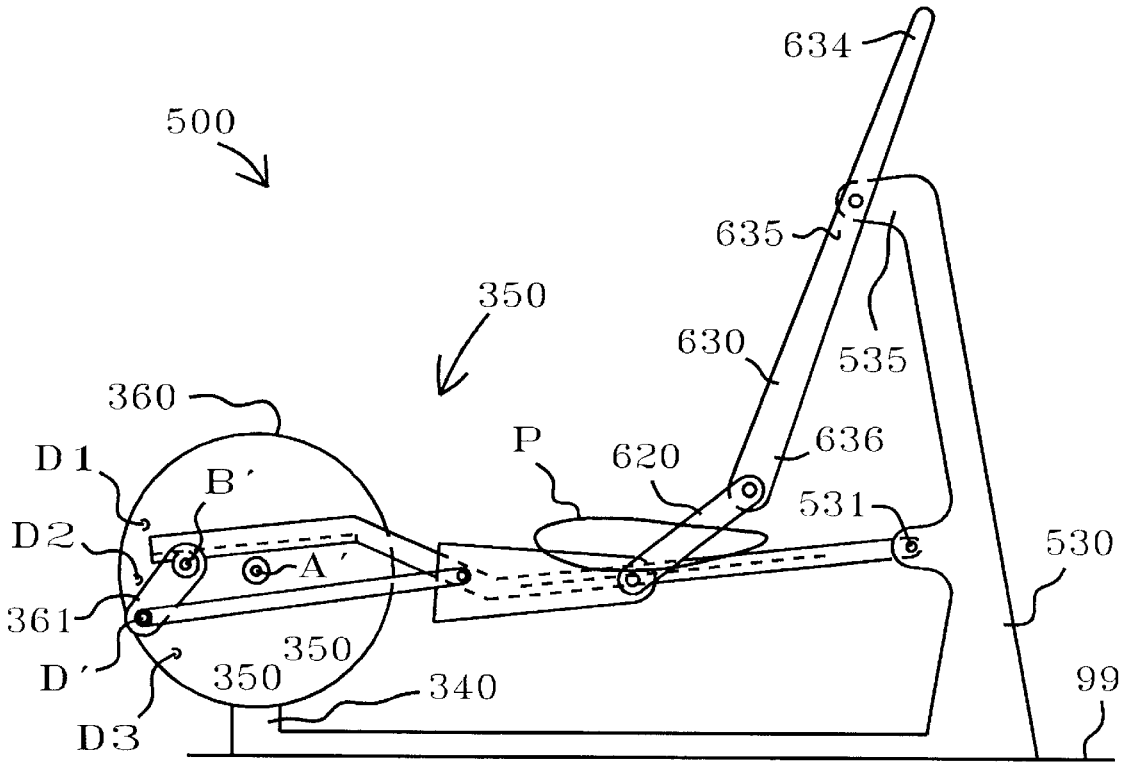
FIG. 8 is a side view of another alternative embodiment exercise apparatus constructed according to the principles of the present invention.

Yet another alternative embodiment of the present invention is designated as 500 in FIG. 8. The exercise apparatus 500 includes a linkage assembly 350 (identical to that of the alternative embodiment 300) movably mounted on a frame 520 and linked to a handle member 630, which is also movably mounted on the frame 520.

A forward end of the rail 400 is pivotally connected to a first trunnion 531 on a forward stanchion 530, at a first elevation above a floor surface 99. A handle member 630 has an intermediate portion 635 which is pivotally connected to a second trunnion 535 on the forward stanchion 530, at a second, relatively greater elevation above the floor surface 99. An upper, distal portion 634 of the handle member 630 is sized and configured for grasping by a person standing on the force receiving member 380. A lower, distal portion 636 of the handle member 630 is rotatably connected to one end of a handle link 620. An opposite end of the handle link 620 is rotatably connected to the force receiving member 380. In operation, the handle link 620 links back and forth pivoting of the handle 430 to movement of the force receiving member 380 through the path of motion P.

Figure 9:
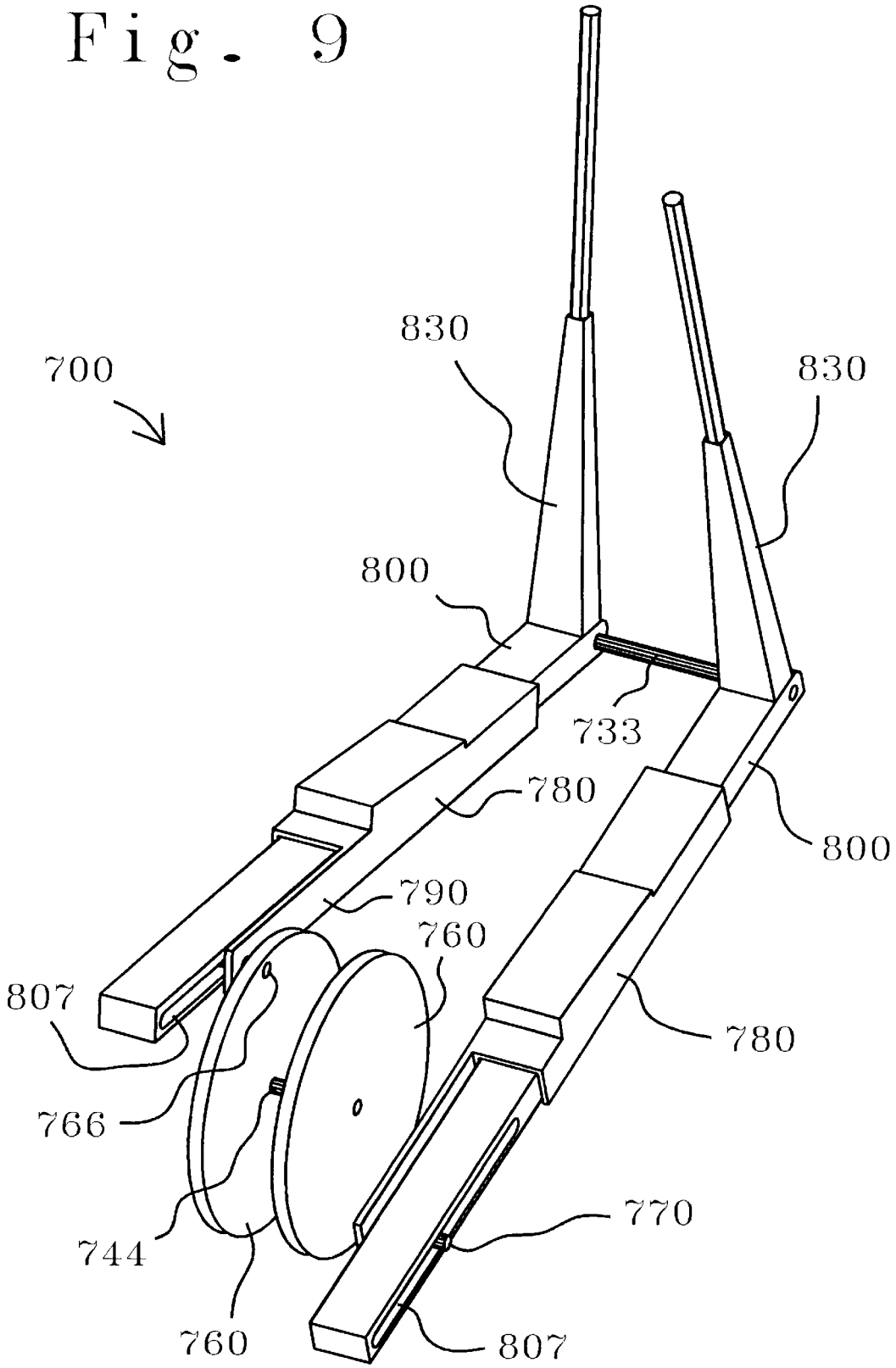
FIG. 9 is a perspective view of yet another alternative embodiment exercise apparatus constructed according to the principles of the present invention.

An alternative embodiment linkage assembly, constructed according to the principles of the present invention, is designated as 700 in FIG. 9. The assembly 700 is movably connected to a frame by means of a forward shaft 733 and a rearward shaft 744. Flywheels 760 are rotatably mounted on the shaft 744 and rotate relative to the frame. A rigid shaft 766 extends axially outward from a radially displaced point on each flywheel 760. Each shaft 766 extends through a hole in a link 790 to a distal end which supports a roller 770. Each roller 770 is disposed within a race or slot 807 formed in the rearward end of a rail 800. The forward end of each rail 800 is pivotally mounted on the shaft 733. In response to rotation of the flywheel 760, the rail 800 rolls back and forth across the roller 770 as the latter causes the former to pivot up and down about the shaft 733. The lower wall of the slot 807 limits upward travel of the rail 800 away from the roller 770.

A handle member 830 is rigidly mounted to the forward end of each rail 800 to pivot together therewith. Alternatively, handle members could be pivotally mounted on the shaft 733, between the rails 800, for example, to pivot independently of the rails 800.

Each link 790 extends forward and integrally joins a respective force receiving member 780 which is rollably mounted on a respective rail 800. In response to rotation of the flywheel 760, the shaft 766 drives the link 790 and the force receiving member 780 back and forth along the rail 800.

Figure 10:
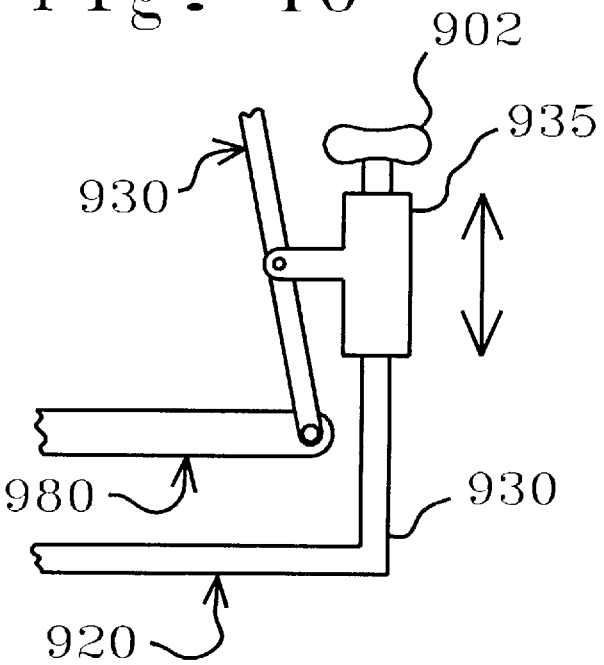
FIG. 10 is a diagrammatic side view of an elevation adjustment mechanism suitable for use on exercise apparatus constructed according to the present invention.

An alternative height adjustment mechanism (in lieu of the ball detent pins and selectively aligned holes described above) is shown diagrammatically in FIG. 10. As with the foregoing embodiments, a frame 920 includes a support 935 movable along an upwardly extending stanchion 930, and a pivoting member 930 is rotatably interconnected between the support 935 and a force receiving member 980. A knob 902 is rigidly secured to a lead screw which extends through the support 935 and threads into the stanchion 930. The knob 902 and the support 935 are interconnected in such a manner that the knob 902 rotates relative to the support 935, but they travel up and down together relative to the stanchion 930 (as indicated by the arrows) when the knob 902 is rotated relative to the stanchion 930.

Figure 11:
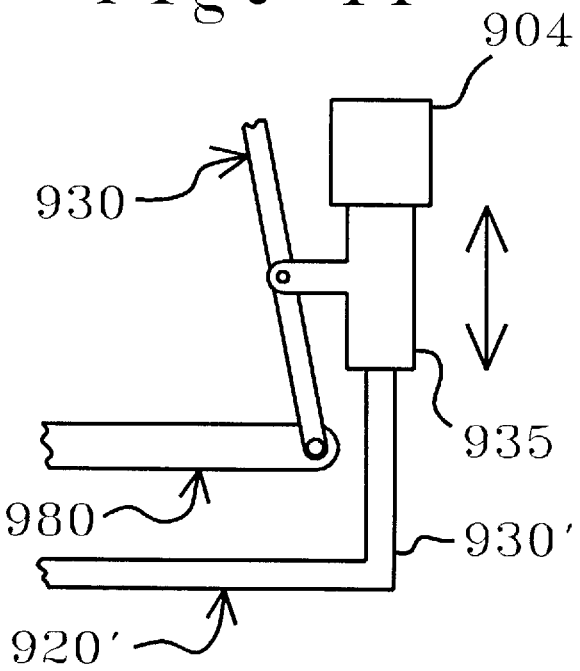
FIG. 11 is a diagrammatic side view of another elevation adjustment mechanism suitable for use on exercise apparatus constructed according to the present invention.
Figure 12:
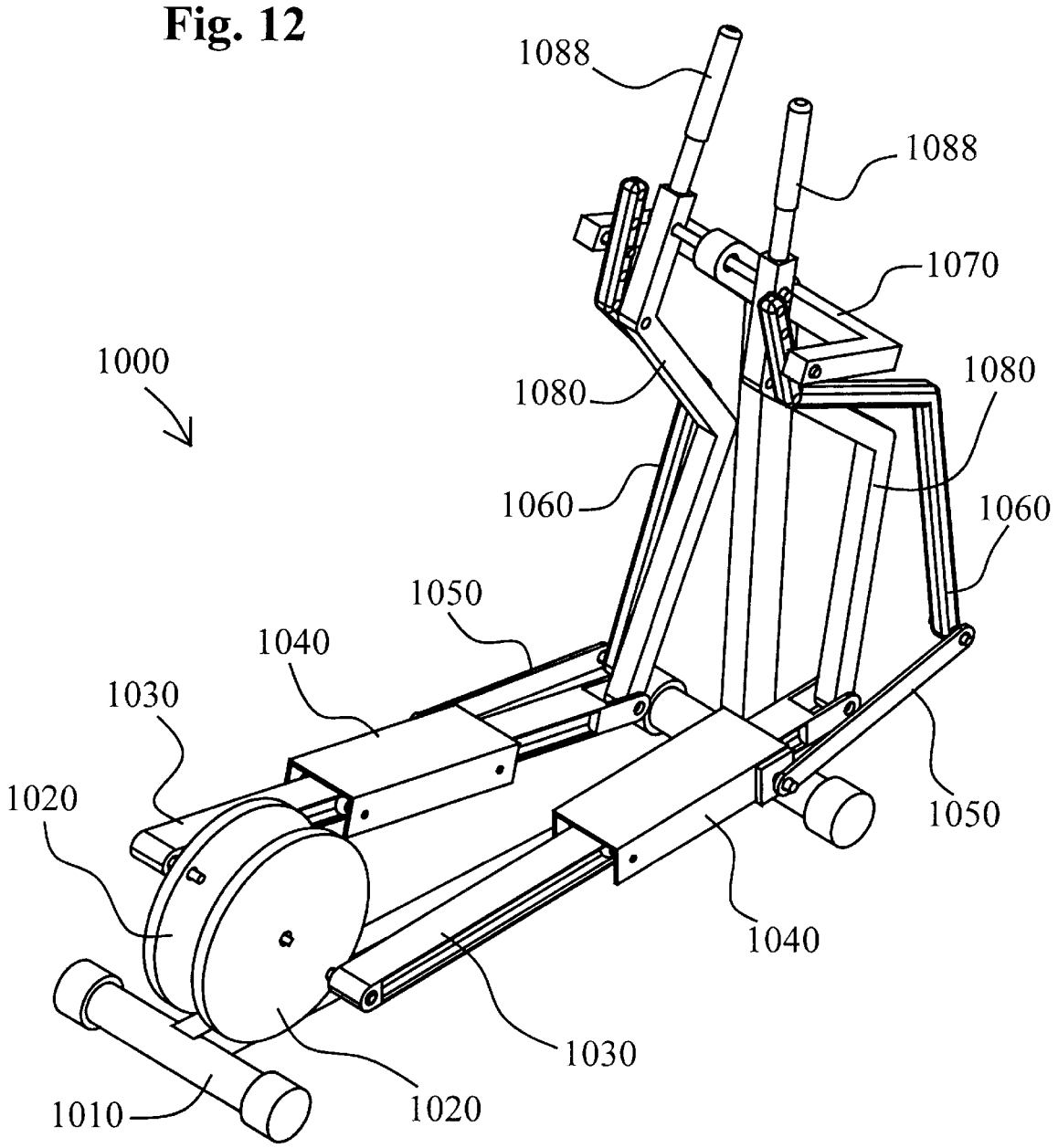
FIG. 12 is a perspective view of another exercise apparatus constructed according to the principles of the present invention.
Figure 13:
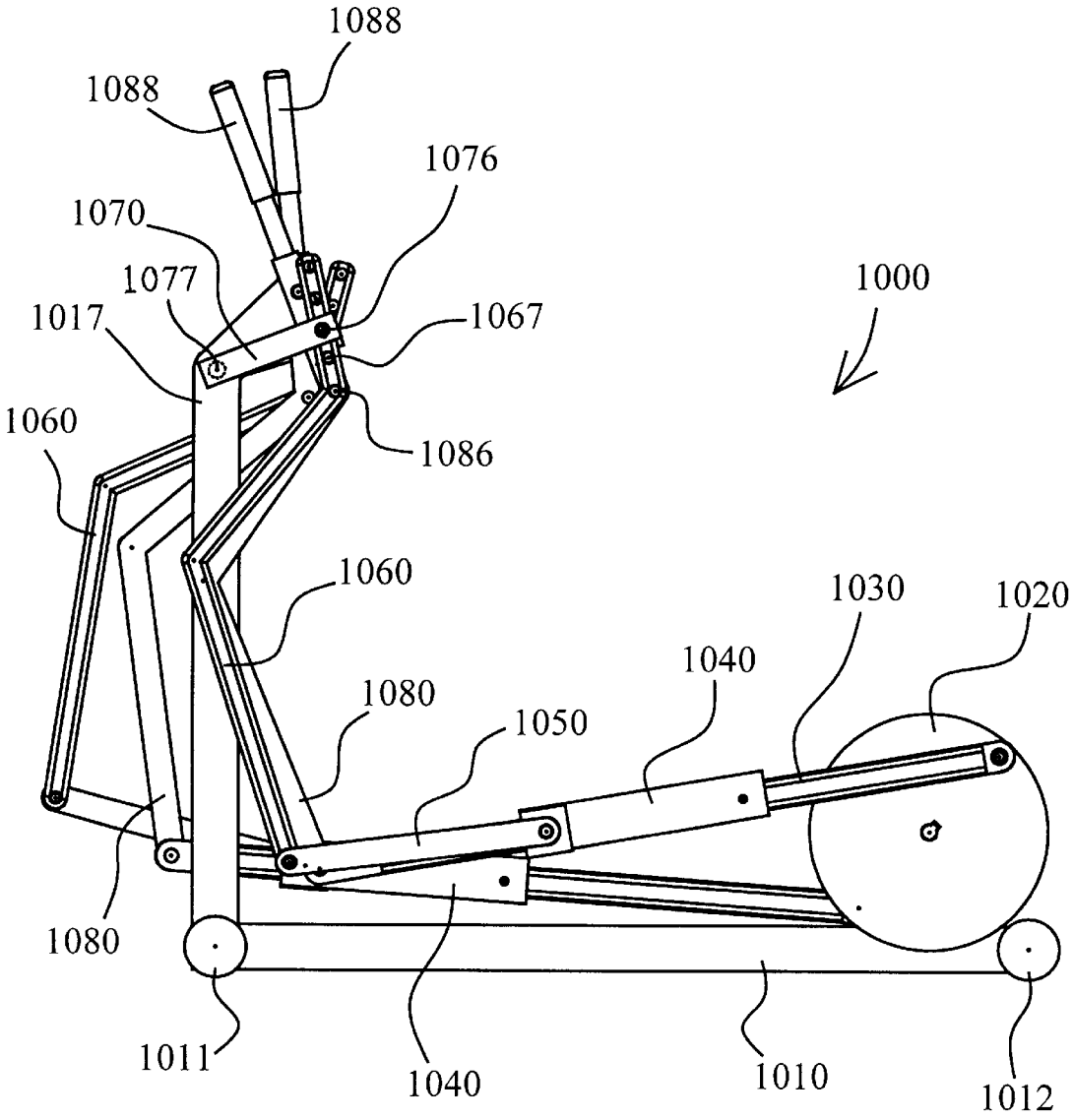
FIG. 13 is a side view of the exercise apparatus of FIG. 12.
Figure 14:
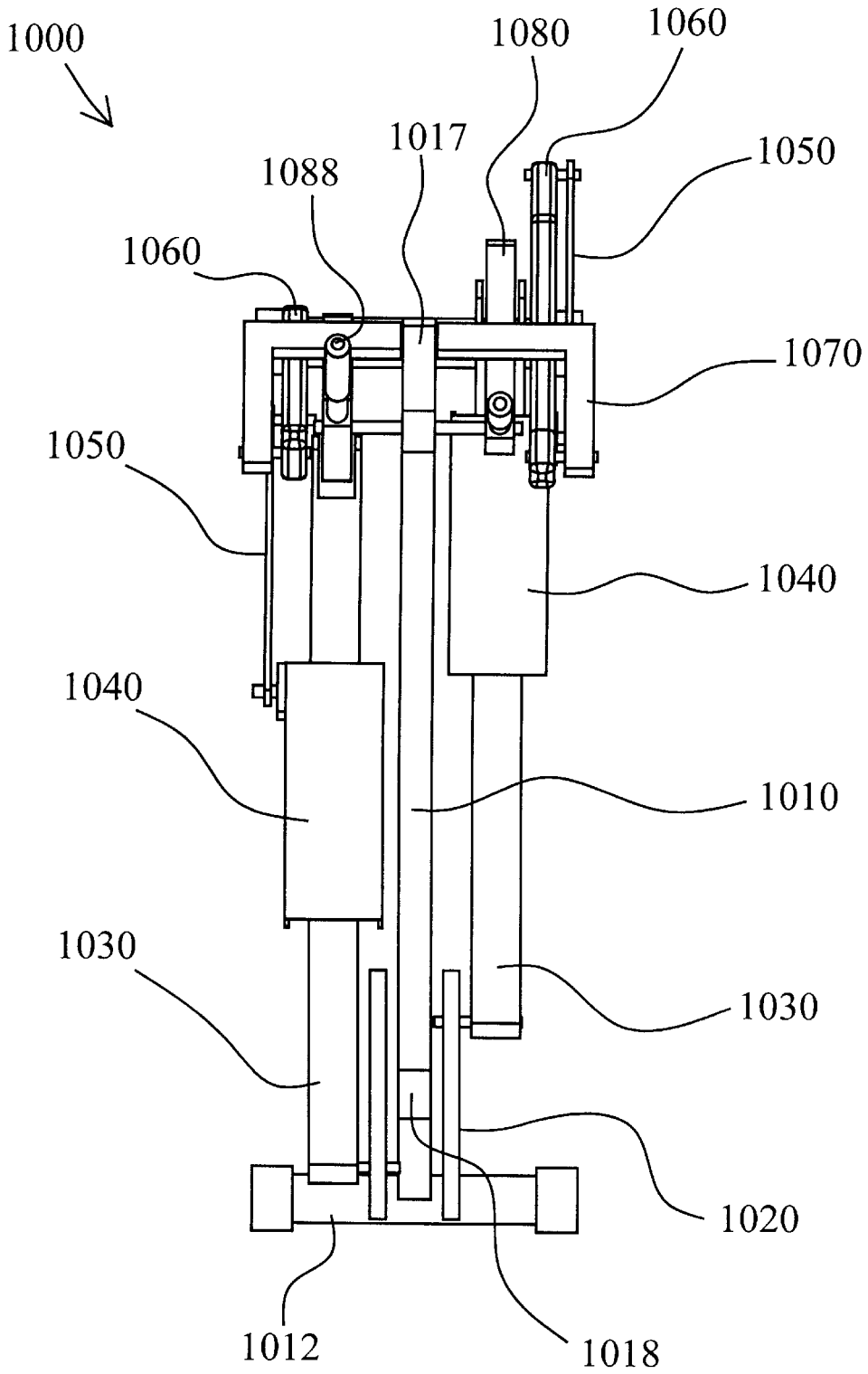
FIG. 14 is a top view of the exercise apparatus of FIG. 12.
Figure 15:
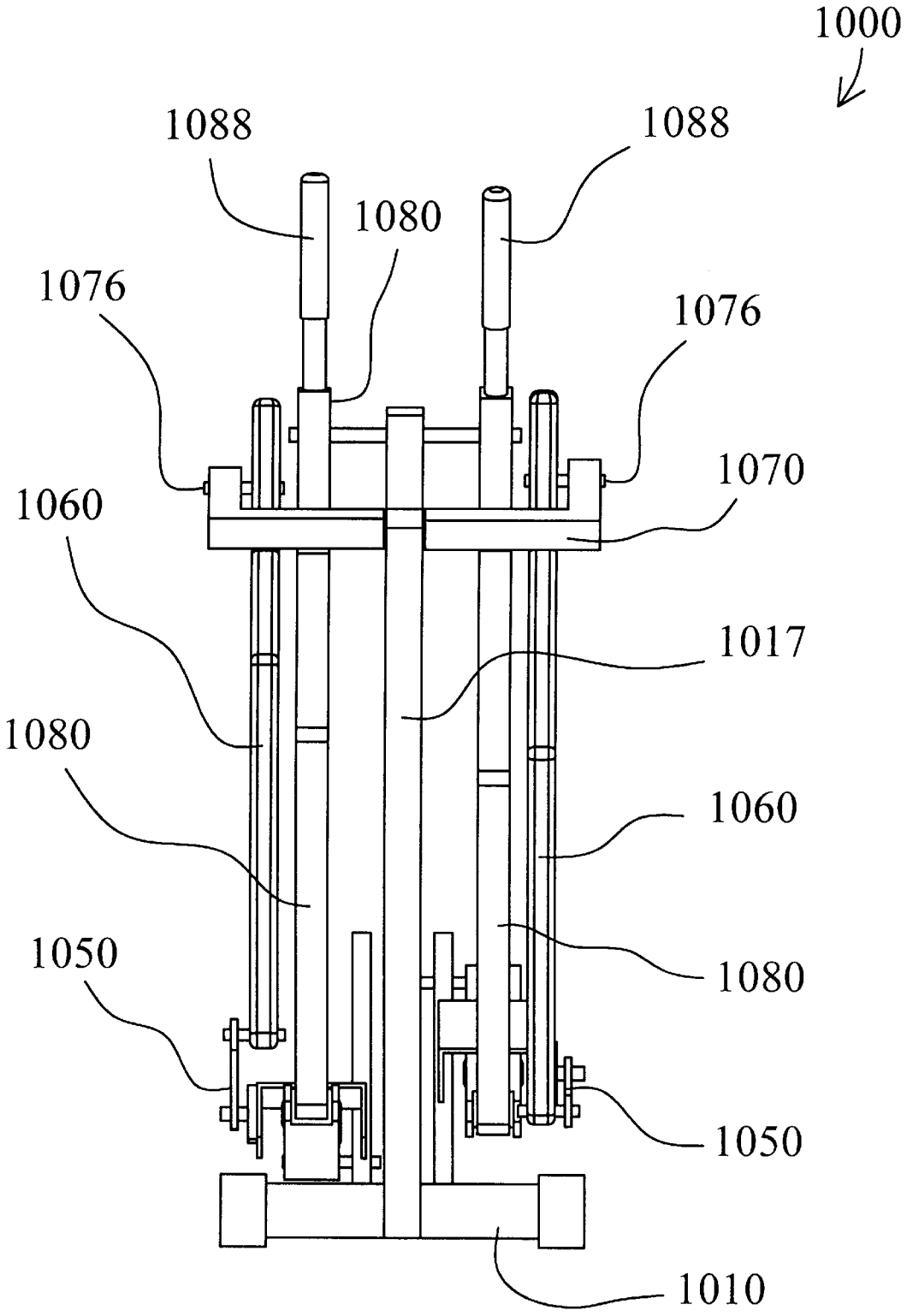
FIG. 15 is a front end view of the exercise apparatus of FIG. 12.
Figure 19:
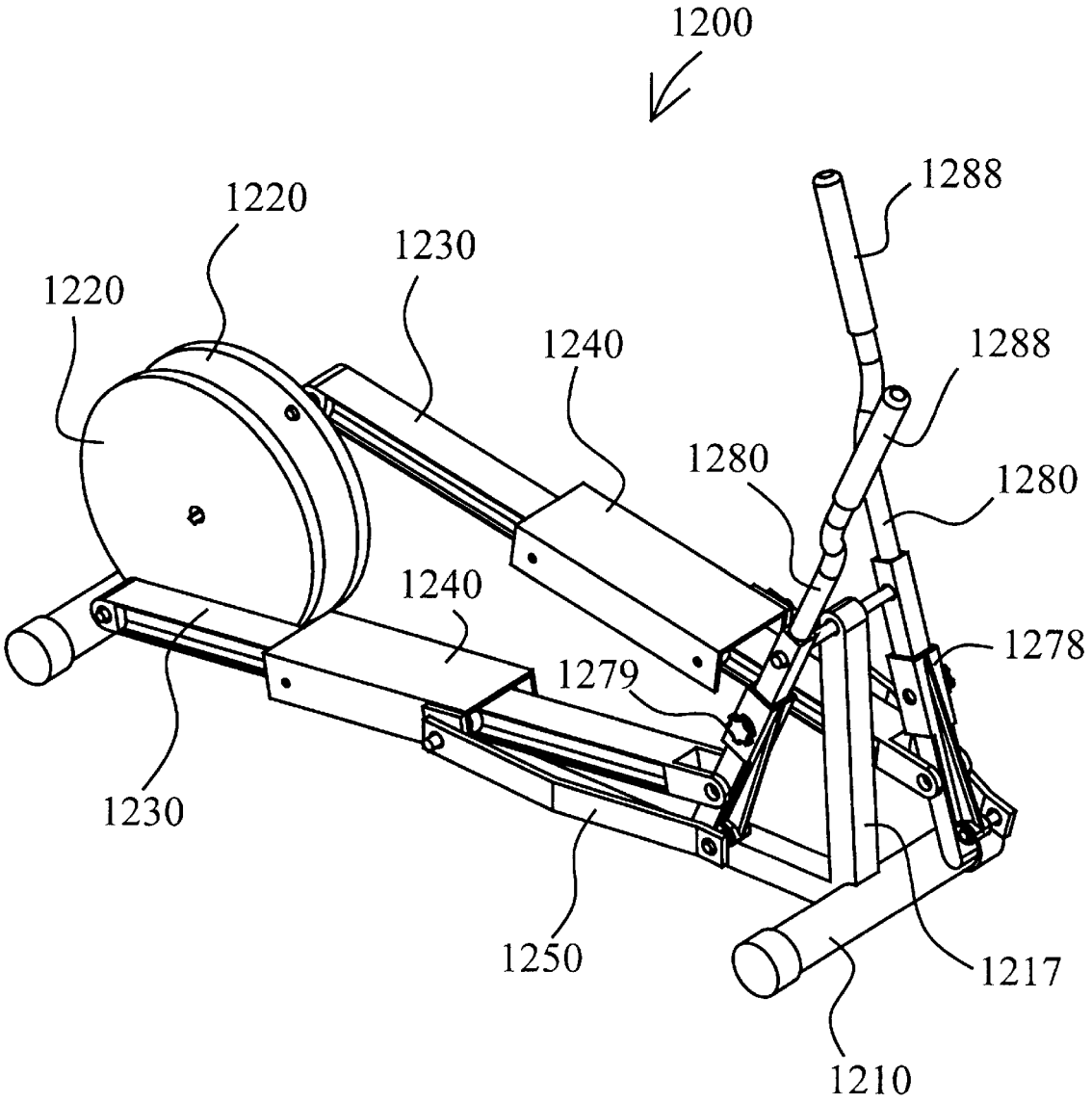
FIG. 19 is a perspective view of another exercise apparatus constructed according to the principles of the present invention.
Figure 20:
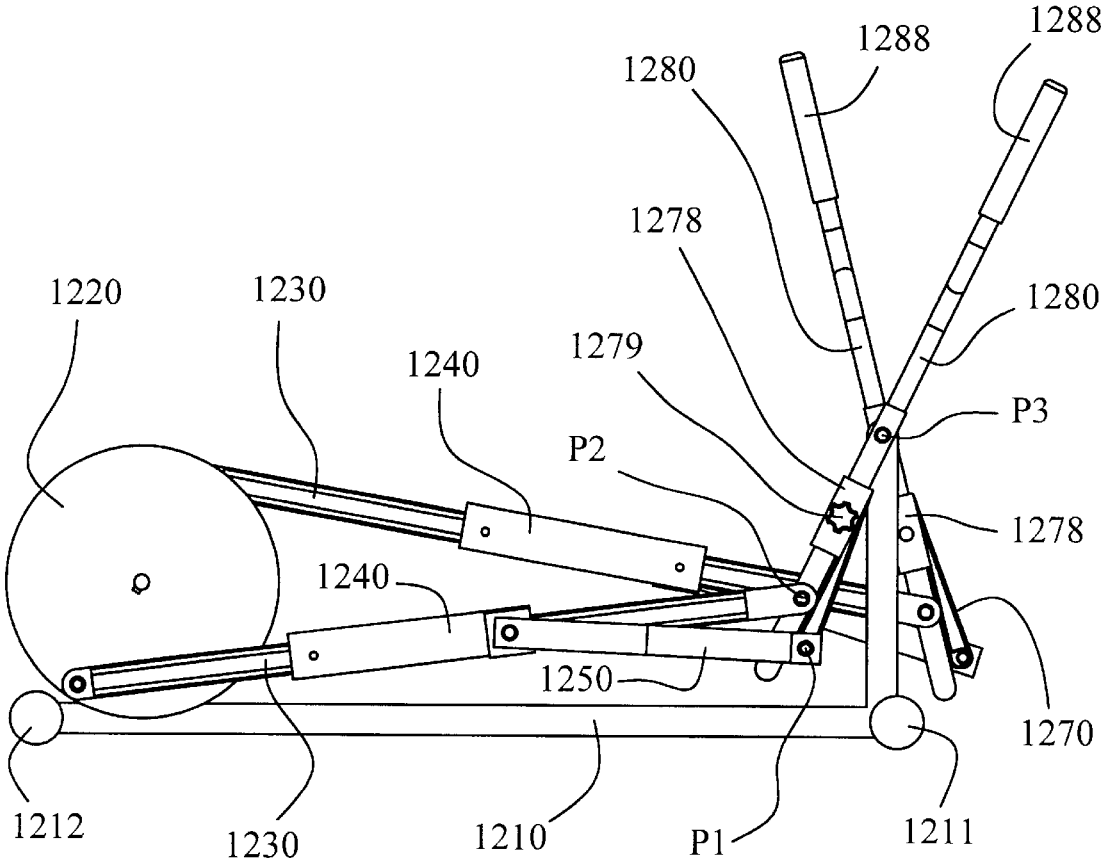
FIG. 20 is a side view of the exercise apparatus of FIG. 19.
Figure 21:
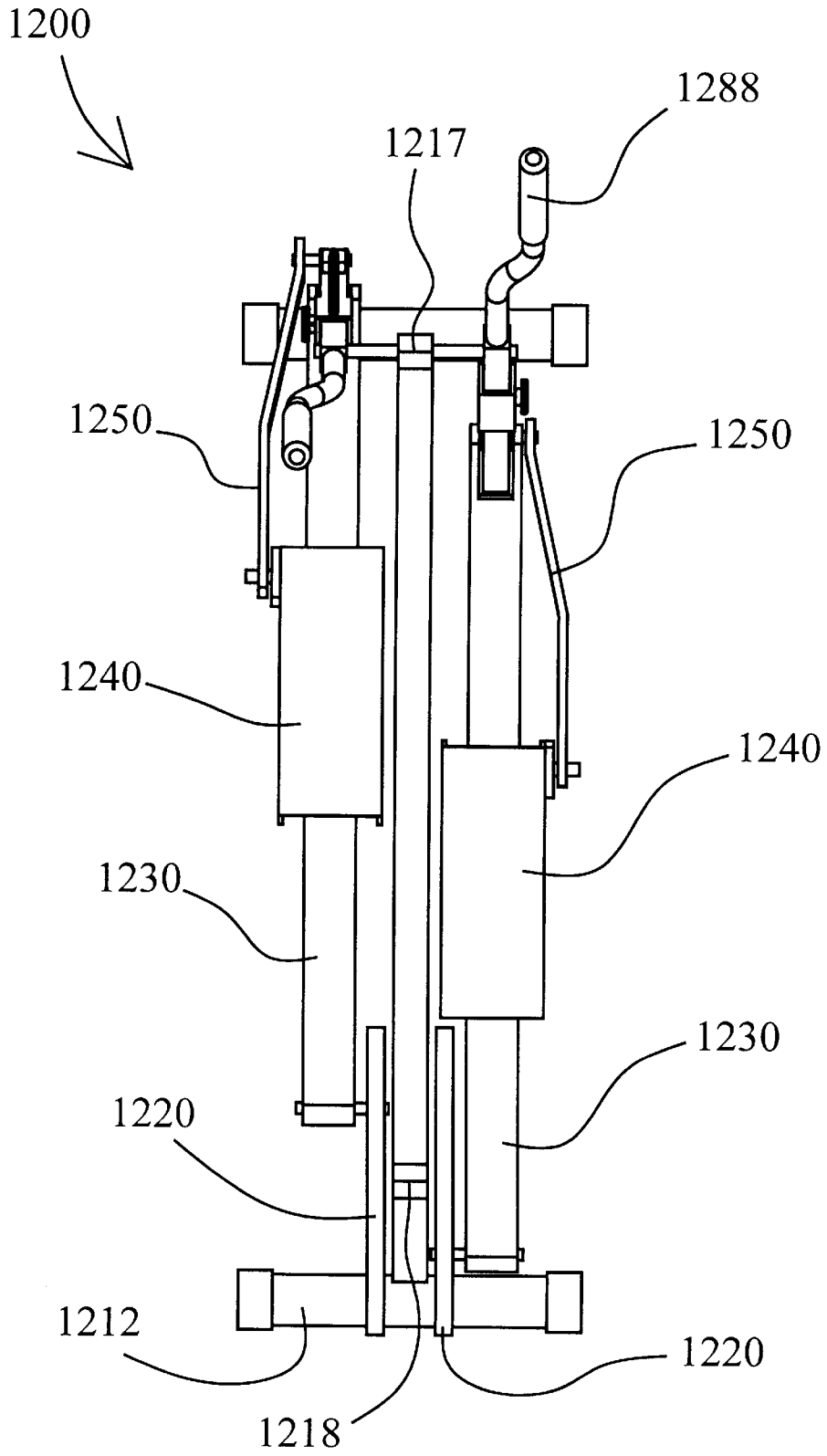
FIG. 21 is a top view of the exercise apparatus of FIG. 19.
Figure 22:
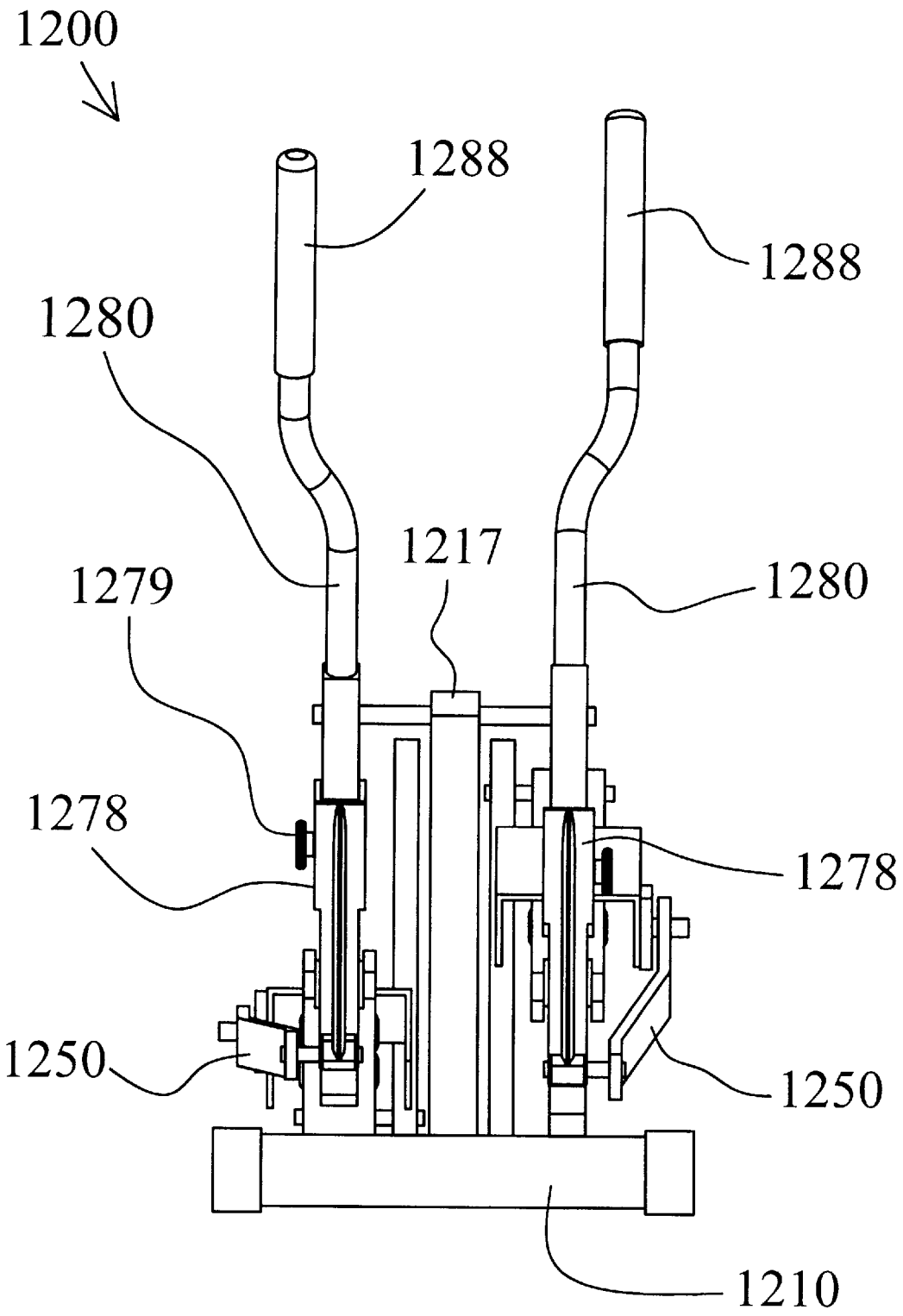
FIG. 22 is a front end view of the exercise apparatus of FIG. 19.

Yet another suitable height adjustment mechanism is shown diagrammatically in FIG. 11, wherein a frame 920' includes a support 935 movable along an upwardly extending stanchion 930', and a pivoting member 930 is rotatably interconnected between the support 935 and a force receiving member 980. A powered actuator 904, such as a motor or a hydraulic drive, is rigidly secured to the support 935 and connected to a movable shaft which extends through the support 935 and into the stanchion 930'. The actuator 904 selectively moves the shaft relative to the support 935, causing the actuator 904 and the support 935 to travel up and down together relative to the stanchion 930' (as indicated by the arrows). The actuator 904 may operate in response to signals from a person and/or a computer controller.

Another embodiment of the present invention is designated as 1000 in FIGS. 12–15. Since many of the general statements and proposed variations regarding other embodiments are applicable to the apparatus 1000, as well, the following description will focus primarily on the particular linkage assembly being implemented. The apparatus 1000 has a frame 1010 which includes a base designed to rest upon a floor surface; a forward stanchion 1017 extending upward from the base 1010 at its forward end 1011; and a rearward stanchion 1018 extending upward from the base 1010 at its rearward end. Left and right flywheels or cranks 1020 are rotatably mounted on the rearward stanchion 1018 and rotate relative thereto about a crank axis.

Left and right rails or links 1030 have rearward ends which are rotatably connected to radially displaced portions of respective cranks 1020. The resulting axes of rotation are disposed at a crank radius from the crank axis. Forward ends of the rails 1030 are constrained to move in reciprocal fashion relative to the frame 1010. Left and right foot supports or skates 1040 are movably mounted on intermediate portions of respective rails 1030. Each skate 1040 is sized and configured to support one foot of a standing person. On the embodiment 1000, opposing pairs of rollers are rotatably mounted on the skates 1040 and rollable along outwardly opening channels on the rails 1030.

Left and right drawbars or links 1050 have rearward ends rotatably connected to respective skates 1040; and forward ends rotatably connected to lower ends of respective rocker links 1060. Opposite, upper ends of the rocker links 1060 are rotatably connected to respective rocker links 1070 at pin joints 1076. The rocker links 1070 pivot about a common axis 1077 (see FIG. 13) relative to the forward stanchion 1017. Multiple holes 1067 are provided in the rocker links 1060 to adjust the locations of the pin joints 1076 along the upper end of the rocker links 1060.

Intermediate portions of the rocker links 1060, disposed just below the upper ends, are rotatably connected to intermediate portions of respective rocker links 1080 at pin joints 1086. The rocker links 1060 may be described as intermediate rocker links because they are disposed and interconnected between the rocker link 1070 and the rocker links 1080. Relatively higher intermediate portions of the rocker links 1080 are rotatably connected to the forward stanchion 1017. Upper distal ends 1088 of the rocker links 1080 are sized and configured for grasping; and lower ends of the rocker links 1080 are rotatably connected to forward ends of respective rails 1030.

The resulting linkage assembly links rotation of the cranks 1020 to generally elliptical motion of the skates 1040. The skates 1040 move vertically together with the rails 1030 and horizontally relative to the rails 1030. With regard to horizontal movement, the cranks 1020 cause the handle bar rockers 1080 to pivot relative to the frame 1010. Since the intermediate rockers 1060 do not share a frame based pivot axis with the handle bar rockers 1080, they pivot relative to the handle bar rockers 1080 and thereby move the skates 1040 relative to the rails 1030. The amount of relative horizontal movement may be adjusted by changing the locations of the pin joints 1076, which are constrained to move in reciprocal fashion relative to both the frame 1010 and the pin joints 1086.

Other reciprocal motion constraints may be substituted for those shown without departing from the scope of the present invention. For example, in one alternative embodiment, slots are provided in the upper ends of the intermediate rocker links to accommodate pins extending from opposite ends of a support configured like the single rocker link 1070. During steady state operation, the support remains rigid relative to the stanchion 1017, and the pins bear against the walls of the slots. The support is selectively rotatable relative to the stanchion 1017 for purposes of adjusting the amount of horizontal movement between the skates 1040 and the rails 1030.

Another embodiment of the present invention is designated as 1100 in FIGS. 16–17. The apparatus 1100 is similar in many respects to the previous embodiment 1000 and thus, the following description will focus primarily on the linkage distinctions.

Left and right cranks 1120 are rotatably mounted on opposite sides of the frame 1110 proximate the rear end thereof, and a stanchion 1117 extends upward from the frame 1110 proximate the front end thereof. Left and right rails 1130 have rear ends rotatably mounted to radially displaced portions of respective cranks 1120; and front ends rotatably connected to lower ends of respective handle bar links 1180. Left and right foot skates 1140 have rear ends movably mounted on intermediate portions of respective rails 1130; and front ends rotatably connected to lower ends of respective rocker links 1160. Opposite, upper ends of the rocker links 1160 are rotatably connected to the forward stanchion 1117; and intermediate portions of the rocker links 1160, proximate the upper ends thereof, are rotatably connected to intermediate portions of the handle bar links 1180 by pin joints 1187.

Upper distal ends 1188 of the handle bar links 1180 are sized and configured for grasping. Upper portions of the handle bar links 1180, disposed between the upper ends 1188 and the pin joints 1187, are rotatably connected to respective rocker links 1170 which, in turn, are rotatably connected to the forward stanchion 1117. The rocker links 1160 are constrained to move in reciprocal fashion relative to both the frame 1110 and respective handle bar links 1180. As a result of this arrangement, the rails 1130 and the links 1160, 1170, and 1180 cooperate to link rotation of respective cranks 1120 to generally elliptical motion of respective foot skates 1140.

Yet another reciprocal motion constraint is designated as 1100' in FIG. 18. The rocker links 1160 are rotatably connected to stanchion 1117', which has been modified to provide multiple points of connection for left and right supports 1175. The supports 1175 provide bearing members 1177 which are disposed within slots 1178 formed in the upper portions of the handle bar links 1180, between the handle ends 1188 and the pin joints 1187. During steady state operation, the supports 1175 remain rigid relative to the stanchion 1117', and the pins 1177 bear against the walls of the slots 1178. The supports 1175 may be selectively repositioned relative to the stanchion 1117' for purposes of adjusting the configuration of the path traversed by the foot skates 1140.

The foregoing embodiments designated as 1000 and 1100 may be modified in other ways, as well. For example, handles may be disposed on upper ends of the links 1060 or 1160 rather than the upper ends of links 1080 or 1180. Also, the foot supports 1140 may be supported by respective flywheel-mounted rollers rather than rail engaging rollers. Furthermore, adjustments to the supports 1175 on the embodiment designated as 1100' may be effected manually or by a powered actuator which selectively moves the supports along the forward stanchion.

Another embodiment of the present invention is designated as 1200 in FIGS. 19–22. Many of the general statements and proposed variations made with reference to other embodiments are applicable to the apparatus 1200, as well. Therefore, the following description will focus primarily on the particular linkage assembly being implemented. The apparatus 1200 has a frame 1210 which includes a base designed to rest upon a floor surface; a forward stanchion 1217 extending upward from the base 1210 proximate its forward end 1211; and a rearward stanchion 1218 extending upward from the base 1210 proximate its rearward end. Left and right flywheels or cranks 1220 are rotatably mounted on the rearward stanchion 1218 and rotate relative thereto about a crank axis.

Left and right rails or links 1230 have rearward ends which are rotatably connected to radially displaced portions of respective cranks 1220. The resulting axes of rotation are disposed at a crank radius from the crank axis. Forward ends of the rails 1230 are constrained to move in reciprocal fashion relative to the frame 1210. Left and right foot supports or skates 1240 are movably mounted on intermediate portions of respective rails 1230. Each skate 1240 is sized and configured to support one foot of a standing person. On the embodiment 1200, opposing pairs of rollers are rotatably mounted on the skates 1240 and rollable along channels on the rails 1230.

Left and right drawbars or links 1250 have rearward ends rotatably connected to respective skates 1240. Forward ends of the drawbars 1250 are rotatably connected to lower ends of respective support members 1270 and thereby define pivot axes P1. Opposite, upper ends of the support members 1270 are rigidly secured to respective bushings 1278. The bushings 1278 are selectively movable along lower portions of respective rocker links 1280 and secured in place relative thereto by respective knob and bolt assemblies 1279.

A lower portion of each rocker link 1280 is rotatably connected to the forward end of a respective rail 1230, as well, thereby defining respective pivot axes P2. An intermediate portion of each rocker link 1280 is rotatably connected to the forward stanchion 1217, thereby defining a pivot axis P3. An upper end of each rocker link 1280 is sized and configured for grasping.

The resulting linkage assembly links rotation of the cranks 1220 to generally elliptical motion of the skates 1240. The pivot axes P1 move through arcs at a first radius from the pivot joint P3, and the pivot axes P2 move through arcs at a second radius from the pivot joint P3. When the first radius is equal to the second radius, there is essentially no relative motion between the foot skates 1240 and the rails 1230. When the first radius is greater than the second radius, the foot skates 1240 travel through a larger range of horizontal motion than the rails 1230. When a longer stride is desired, the pivot axes P1 are adjusted downward relative to the rocker links 1280, and conversely, when a shorter stride is desired, the pivot axes P1 are adjusted upward relative to the rocker links 1280.

Recognizing that the foregoing description and drawings set forth only some of the numerous possible embodiments and variations of the present invention, and that numerous other modifications and interchanging of features are suggested thereby, the scope of the present invention is to be limited only to the extent of the claims which follow.

What is claimed is:

1. An exercise apparatus, comprising:

a frame designed to rest upon a floor surface;

left and right cranks rotatably mounted on said frame;

left and right rocker links pivotally mounted on said frame;

left and right rails having first ends rotatably connected to respective cranks and second ends rotatably connected to respective rocker links;

left and right foot supports movably mounted on respective rails;

at least one left link interconnected between said left rocker link and said left foot support in such a manner that rotation of said left crank causes said left foot support to move vertically together with said left rail and horizontally relative to said left rail; and at least one right link interconnected between said right rocker link and said right foot support in such a manner that rotation of said right crank causes said right foot support to move vertically together with said right rail and horizontally relative to said right rail.

2. A method of linking rotation of left and right cranks to generally elliptical motion of left and right foot supporting members, comprising the steps of:

providing a frame sized and configured to support a person relative to an underlying floor surface;

rotatably mounting the left and right cranks on the frame;

pivotally mounting left and right rocker links on the frame;

movably interconnecting left and right rails between respective rocker links and respective cranks;

movably mounting left and right foot supports on respective rails; and connecting the foot supports to respective rocker links in such a manner that rotation of the cranks causes each of the foot supports to move vertically together with a respective rail and horizontally relative to a respective rail.

* * * * *